US007568321B2

(12) United States Patent
Morey et al.

(10) Patent No.: US 7,568,321 B2
(45) Date of Patent: Aug. 4, 2009

(54) ADOBE BUILDING CONSTRUCTION SYSTEM AND ASSOCIATED METHODS

(75) Inventors: Lisa T. Morey, Winter Park, FL (US); Vince Ogletree, Orlando, FL (US); Lisa T. Morey, legal representative, Orlando, FL (US)

(73) Assignee: Adobe Building Systems, LLC, Winter Park, FL (US)

( * ) Notice: Subject to any disclaimer, the term of this patent is extended or adjusted under 35 U.S.C. 154(b) by 137 days.

(21) Appl. No.: 11/610,659

(22) Filed: Dec. 14, 2006

(65) Prior Publication Data

US 2007/0137138 A1 Jun. 21, 2007

Related U.S. Application Data

(60) Provisional application No. 60/750,249, filed on Dec. 14, 2005.

(51) Int. Cl.
*E04B 1/02* (2006.01)
*E04B 5/04* (2006.01)
*E04G 21/00* (2006.01)

(52) U.S. Cl. ..... 52/747.1; 52/606; 52/565

(58) Field of Classification Search ..... 52/223.14, 52/169.9, 223.1, 223.4, 223.5, 747.12, 297, 52/293.1, 293.2, 294–296, 223.6, 223.7, 52/600, 606, 396.08, 604, 605; 256/16
See application file for complete search history.

(56) References Cited

U.S. PATENT DOCUMENTS

| | | | | |
|---|---|---|---|---|
| 0,314,022 | A | 3/1885 | Heard | |
| 341,796 | A * | 5/1886 | Craine | 52/295 |
| 1,524,146 | A | 1/1925 | Murray | |
| 1,683,441 | A | 9/1928 | Bone | |
| 2,118,936 | A | 5/1938 | Malinovszky | |
| 2,141,397 | A | 12/1938 | Locke | |
| 2,881,613 | A | 4/1959 | Taylor et al. | |
| 3,430,403 | A | 3/1969 | Muse | |
| D223,248 | S | 4/1972 | Pickel | |
| 3,847,632 | A * | 11/1974 | Blengsli | 106/718 |
| 4,161,852 | A | 7/1979 | Schultz | |
| 4,821,483 | A * | 4/1989 | Adams | 52/747.12 |
| D305,573 | S | 1/1990 | Sakata | |
| 5,007,218 | A * | 4/1991 | Bengtson et al. | 52/204.2 |
| 5,024,035 | A | 6/1991 | Hanson et al. | |
| 5,048,250 | A | 9/1991 | Elias | |
| 5,197,245 | A * | 3/1993 | Davis | 52/223.7 |
| 5,241,795 | A | 9/1993 | Giroux et al. | |
| 5,564,865 | A * | 10/1996 | Jansson | 405/286 |
| 5,678,373 | A * | 10/1997 | Franklin et al. | 52/439 |

(Continued)

*Primary Examiner*—Richard E Chilcot, Jr.
*Assistant Examiner*—Elizabeth A Plummer
(74) *Attorney, Agent, or Firm*—Allen Dyer Doppelt Milbrath & Gilchrist

(57) ABSTRACT

A method of constructing an adobe building from adobe bricks, at least some having a hollow core therethrough, includes assembling adobe bricks atop one another to form a vertical wall structure, so that the hollow cores align to form a vertical channel. An extended reinforcing member is inserted through the channel, and a building material is poured into and set in the vertical channel. Electrical, plumbing, and other service systems can be formed into the wall. If desired, a substantially planar reinforcing structure can be placed between layers of bricks, resulting in a horizontally reinforced wall structure. A method of forming a scaffolding is also provided, wherein the scaffold supports are inserted into depressions in some of the bricks.

12 Claims, 3 Drawing Sheets

U.S. PATENT DOCUMENTS

| | | | | |
|---|---|---|---|---|
| 5,685,119 | A | 11/1997 | Zschoppe | |
| 5,878,544 | A * | 3/1999 | McKinnon | 52/566 |
| 6,088,987 | A * | 7/2000 | Simmons et al. | 52/592.6 |
| 6,195,955 | B1 * | 3/2001 | Kostopoulos | 52/741.13 |
| 6,402,435 | B1 * | 6/2002 | Lewis | 405/284 |
| 6,431,797 | B2 * | 8/2002 | Greenberg | 405/284 |
| 6,571,525 | B2 * | 6/2003 | Coleman | 52/592.5 |
| 6,588,168 | B2 * | 7/2003 | Walters | 52/604 |
| 6,718,722 | B2 | 4/2004 | Worrell et al. | |
| 6,735,913 | B2 * | 5/2004 | Sanders et al. | 52/284 |
| 6,758,020 | B2 * | 7/2004 | Cerrato | 52/606 |
| 7,086,811 | B2 * | 8/2006 | Lewis | 405/284 |
| 2003/0188501 | A1 | 10/2003 | Busch et al. | |
| 2004/0226246 | A1 * | 11/2004 | Doty | 52/503 |
| 2006/0201082 | A1 * | 9/2006 | Hammer et al. | 52/223.5 |
| 2007/0186502 | A1 * | 8/2007 | Marsh et al. | 52/604 |

* cited by examiner

ADOBE BUILDING CONSTRUCTION SYSTEM AND ASSOCIATED METHODS

CROSS-REFERENCE TO RELATED APPLICATION

This application claims priority to provisional application Ser. No. 60/750,249, filed Dec. 14, 2005, entitled "Adobe Building Construction and Associated Methods," the disclosure of which is incorporated hereinto by reference.

FIELD OF THE INVENTION

The present invention is directed to building construction devices and methods, and, more particularly, to such devices and methods for constructing buildings from adobe materials.

BACKGROUND OF THE INVENTION

Using adobe for house construction utilizes one of the world's most energy-efficient materials, earth. Recent research shows that the construction of homes, using common, contemporary materials and techniques, impacts the environment more than any other industrial activity. Research also confirms that earthen walls use only 10 percent of the embodied energy of ordinary house walls. Building homes with earthen walls, therefore, burdens the environment at a lower level than any other home building method and uses less embodied energy from the outset. A well-built earthen home can outperform with regards to durability, thermal dynamics, longevity, and structural integrity to a well-built timber frame home. Timber frame construction is the most common method of home building in the so-called developed world. Adobe walls have better thermal dynamics than conventional timber-frame buildings, i.e., warm in the winter, cool in the summer.

The R-value of a material is its ability to resist changes in temperature, or in simpler terms, how good of an insulator it is. (Polystyrene, for example, has a very high R-value). Mud brick walls have a fairly low R-value of 0.4, meaning that heat will transfer through the brick over time. Brick veneer has an R-value of 0.46 and double brick 0.56, meaning they will absorb slightly less heat than a single-skinned mud brick wall.

Thermal mass is how much energy or heat a material holds. Mud brick has a high thermal mass, meaning that when the brick heats up, it holds its heat and releases it slowly. In a well-designed solar passive mud brick home, winter sun heats the mud bricks during the day. This heat is held in the brick and released during the night, keeping the home warm. Conversely, sun is kept off the mud brick walls during summer so they stay cool during the day and night.

The use of earthen materials in building construction is thousands of years old. However, certain difficulties are known to inhere in such constructions, particularly, in providing conduits for plumbing and electricity, and also in providing sufficient reinforcement. The use of scaffolding has also not been known in adobe construction.

Therefore, it would be desirable to provide an adobe construction and method therefore that can address these problems.

SUMMARY OF THE INVENTION

The present invention is directed to a system and method for constructing adobe buildings that is environmentally friendly, easy to achieve, and stronger than prior known adobe constructions. Part of the method includes the use of scaffolding that is incorporated in the building as it is constructed.

A first aspect of a method of constructing an adobe building can comprise the step of forming a plurality of adobe bricks, at least some of the bricks having a hollow core therethrough extending from a top surface through to a bottom surface. A plurality of layers of the adobe bricks are assembled atop one another to form a substantially vertical wall structure, in such a manner that the hollow cores align to form a substantially vertical channel.

An extended reinforcing member is inserted through the vertical channel, and a settable building material is poured into the vertical channel. The building material is permitted to set around the reinforcing member. Thus an adobe wall has been formed with additional vertical reinforcement imbedded therein.

In some embodiments, electrical, plumbing, and other service systems can be formed into the wall. In this embodiment, prior to the pouring step, a services conduit is inserted through the vertical channel.

In another aspect of the invention, the method of constructing an adobe building comprises the step of assembling a plurality of layers of adobe bricks to form a first part of a substantially vertical wall structure, by joining adjacent bricks together with a settable building material. A substantially planar reinforcing structure is placed atop a layer of bricks. The assembling and placing steps are repeated a plurality of times to form a complete substantially vertical wall structure, with settable building material placed between the reinforcing structure and a next layer of bricks. The building material is permitted to set between the layers of bricks, resulting in a horizontally reinforced wall structure.

In a further aspect of the invention, the method of constructing an adobe building comprises the step of forming a plurality of adobe bricks. One layer of the bricks comprises at least two bricks having depressions therein, the depressions at a substantially same height and in horizontally spaced relation from each other.

A receptacle member that has an opening at a first end leading into a lumen is inserted substantially horizontally into the depressions. A settable building material is poured into the depressions to substantially surround the receptacle members, and the building material is permitted to set around the receptacle members.

An extended support member is inserted into the receptacle lumina, and a substantially planar scaffolding member is placed atop the support members. The scaffolding member is then used from upon which to assemble a second plurality of layers of the adobe bricks atop the first plurality of layers of adobe bricks.

DETAILED DESCRIPTION OF THE PREFERRED EMBODIMENTS

Figure 1:
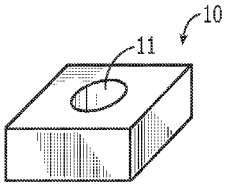
FIG. 1 is a side perspective view of an "O" brick.
Figure 2:
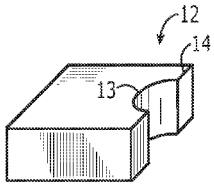
FIG. 2 is a side view of a "U" brick.
Figure 3:
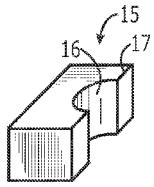
FIG. 3 is a side perspective view of a "half" brick.
Figure 4:
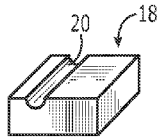
FIG. 4 is a side perspective view of a scaffold standard brick.
Figure 5:
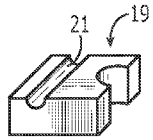
FIG. 5 is a side perspective view of a scaffold "U" brick.

A detailed description of the preferred embodiments will now be presented with reference to FIGS. 1-12.

Adobe materials comprise a mixture of sand and clay, with an optimal proportion comprising approximately 75% sand (or sand with some silt or fine gravel) and 25% clay. A soil stabilization engineer can be used to design an appropriate mix. An exemplary range of material properties and proportions is given in Table 1.

TABLE 1

Adobe brick composition data

| Raw material | Grain size (diam. in mm) | Proportion (%) |
|---|---|---|
| Sand | 0.006-2 | 70-75 |
| Silt | 0.002-0.06 | <35 |
| Clay | <0.002 | 20-25 |
| Gravel/aggregate | ≦16 | <25 |

In a preferred embodiment, the adobe comprises about 70% sand, 23.5% clay, 6.5% cement, and just enough water to achieve a desired consistency. Preferably the water is substantially free from chemical contaminants and significant amounts of dissolved solids.

The amount of clay in the mix affects the workability as well as the overall wall strength and durability. If a wall is constructed with a material that has an excessive amount of clay and it becomes saturated for long periods of time, the material in the wall may become hydraulic, i.e., start slowly moving, which could eventually result in early wall failure. High-clay/low-sand materials will feel greasy and will be heavy and sticky, clinging to the surface of the equipment and tools. This can seriously impede production. It is also important to note that certain clays are very susceptible to swell and shrinkage, making them marginally useful in adobe construction. If the raw material contains too much clay and not enough sand, it is advisable to add sand and, if available, aggregate can be very useful.

Ordinary Portland cement (OPC) acts as a stabilizer, thus limiting the brick's capacity to erode from water or to prematurely deteriorate through holding moisture. The amount of stabilization in the mix also affects the overall strength. Desired results are usually achieved with stabilizer percentages in a range of 3-12%. A higher percentage of cement makes a form of concrete that is beyond the requirements of most three-story homes. Only a small percentage of cement is needed to stabilize the bricks effectively. If desired, aggregate can be added to the mix, which works with the sand and clay to strengthen the mix. It also displaces an equal amount of adobe (that would require cement), so that by adding aggregate, the cement content may be reduced somewhat.

The use of cement allows the freshly molded bricks to be handled within hours of being cast (molded), improve overall durability, and protect against unexpected concentrated water damage (e.g., leaky pipes, broken gutters).

Another important advantage of cement is that freshly molded bricks "set-up" overnight and they can be stacked the next day. The real benefit of this is that bricks can be made in the same space that day. The space for making bricks (called runs) must be carefully leveled and graveled (one time only). Therefore it is practical to use the same run(s) over and over.

Adobe brick buildings can use a variety of the specially shaped bricks measuring 11¼×11¼×5¼ in. for imperial-based constructions or 280×280×120 mm for metric-based constructions (except for half-sized bricks). In the following the bricks will be referred to as: "standard bricks," "U-bricks," "O-bricks," "scaffold bricks," and "half-bricks." The molds for all but the standard bricks have various "block-outs" which give the bricks their final shape and name. The following descriptions and sizes are meant to be exemplary and are not intended to be limiting on the invention.

"Standard bricks" are solid bricks (with no holes in them); they are required more than any other type, being used wherever reinforcing, services, or scaffolding bricks are not required.

"O-bricks" 10 (FIG. 1) have a 4½-in.-(115-mm-) diameter hole 11 in the center of the brick 10.

"U-bricks" 12 (FIG. 2) have half of a 4½-in. (115-mm) hole 13 blocked out from one end 14 of the brick 12. Two U-bricks 12 can come together to form a clean vertical core in the wall, which then can be used for reinforcing (steel bars with concrete grout) or services such as electrics, plumbing, and spare sleeves.

"Half-bricks" 15 (FIG. 3) have half of a 4½-in. (115-mm) hole 16 blocked out from one end 17 of the brick 15, and are needed to start the corners in the "stretcher-bond" (each course half-laps the previous course). For the corners a half-brick 15 comes together with a U-brick 12 to form a clean vertical core in each corner of the building. A combination of half-bricks 15 and U-bricks 12 (forming even courses) and O-bricks 10 (forming odd courses) at window and door openings form a clean vertical core on both sides of each opening.

"Scaffold standard bricks" 18 (FIG. 4) and "scaffold U-bricks" 19 (FIG. 5) accept self-supporting scaffolding pipes through the wall horizontally via channels 20,21, respectively. The scaffold system will be discussed further in the following.

One of skill in the art will appreciate that bricks of virtually and shape and size for different portions of the building can be molded as desired.

The system accommodates reinforced concealed concrete columns, service sleeves for electrical lines and plumbing, and scaffolding.

Figure 6:
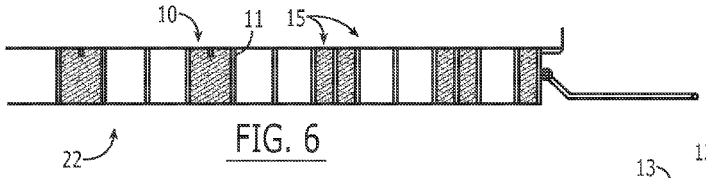
FIG. 6 is a side cross-sectional view of a mold for both "O" and "half" bricks.
Figure 7:
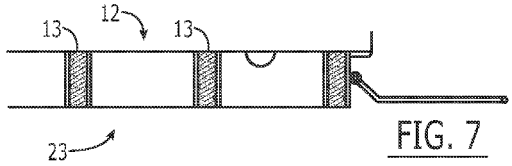
FIG. 7 is a side cross-sectional view of a mold for a "U" brick with a scaffold pipe block-out.

Two exemplary mold designs 22,23 are shown in FIGS. 6 and 7. The molds can form bricks with hollow cores 11 of 4½ in. (115 mm) for O-bricks 10 and half that size for half-bricks 15. The half-hole 13 in a U-brick 12 is similarly formed as shown for the mold 23 of FIG. 7. The formed cores enable reinforcement of the walls for anti-seismic and anti-wind-load structures. Concealed columns are formed within the finished adobe wall by placing steel in the center of the core and then grouting with concrete (¼-in. or 7-mm aggregate). The cores have the secondary purpose of allowing the installation of electrical or plumbing services as required. Pipe or conduits up to 4 in. (105 mm) (outside diameter) can be installed.

Adobe brick molds can be made of either wood, steel, or heavy-duty plastic.

An exemplary category of brick molding that can be used with the present system is called the "slip-molding technique." A group of three molds (6 bricks cast per one mold) are placed side by side on leveled ground. Stabilized adobe mud, which is in a semi-liquid state once it has exited an ordinary concrete mixer, is delivered in a wheelbarrow to the series of three molds. Then all at once, the mud is tipped into the molds and the molds are packed, filled, and then lifted off straightaway. The fresh adobe mix holds its shape immediately and can be gently handled and stacked the next day.

Slab footings integrate the slab with the footing. First, the footings are dug, reinforced, and poured with concrete to just above ground level (using a predetermined level). There are three main ways to create the stem for the slab: by using wooded form-work (timber boxing), or by laying-up concrete blocks, or by laying-up concrete bricks. Concrete bricks can be molded in the adobe molds in the same way as adobe bricks. They resemble the shape of adobe bricks and match the patterning of the adobe wall, and if slurry-washed, hand-bagged, or plastered they are indistinguishable from the adobe wall. This method is especially useful in the case of sloping ground (tall footings). All three methods require that concrete footings be brought up to slab level, which forms the containment when pouring the slab and the loading for the finished slab.

"Deformed rods" rather than smooth rods are preferably used to reinforce the footing. Deformed rods have been cast with indentations to which the dry concrete can cling.

Main wall reinforcing is further covered in the following. The main wall reinforcing rods are placed in the planned locations by inserting short rods, called starters, into the wet concrete footings. The starters extend from the finished footing level by their required overlap length so they can be added to later. The overlap length locks rods together when the cores are grouted with concrete.

A vertical rod should be used to tie the walls to the footings every 36 in. (900 mm), or less, along the wall. Wherever there is not a main wall reinforcement rod, the 36-in. (900-mm) requirement still should be met. "Stubs" are short rods used to meet this requirement. They only extend 11 in. (280 mm) into the adobe wall and are grouted after the second course of adobe bricks is laid.

Profiles and string-lines are used to maintain horizontal alignment.

One of the rewards of wet-molded adobe bricks is their slight irregularity, in contrast to precision-cast bricks, which require precision lay-up. Less accuracy is required, as a tolerance of ¼ in. (5 mm) or more is structurally acceptable. It is only a matter of preference.

Bricks should be laid near to level in the directions across as well as along the wall. They must also be laid parallel to the string-line with the top of the bricks level with the string-line. It is best to allow 1/16 in. (1.5 mm) clear from the string line. If no gap is left, the string tends to get pushed away from the wall, with bits of debris clinging to the brick, causing the wall to bulge.

The brick should be gently laid upon the mortar using care to not let the weight of the brick drop suddenly onto the bed join, as it will cause the brick to settle too far below the string line, which will require the brick to be taken out and more mortar to be added. If the bed join takes the weight of the brick, and the brick does not settle below the string line, firm pressure can be applied until it reaches the appropriate level and final position. It should finally be tapped downwards and along (to compress the "butter" or vertical join) with a rubber mallet, which will cause the brick to key to the bed join, and the bed join to key to the brick course below.

Figure 8:
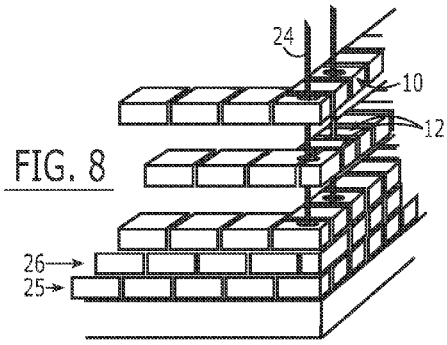
FIG. 8 is a side perspective view of five courses of adobe bricks being laid.

Brick patterns should be laid according to their course ("odd courses" or "even courses"; see FIG. 8). Within the course the pattern of bricks used repeats itself from the bottom to the top (with only a few exceptions that are planned for and described hereafter). The bricks on even courses are stepped over a half-brick 15 from the odd courses, forming a pattern called the "running" or "stretcher-bond pattern."

Figure 9A:
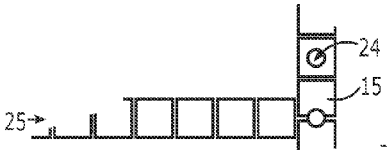
FIGS. 9A, 9B are top plan views of the first and second course of bricks in position.
Figure 9B:
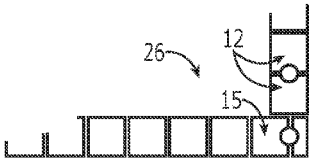
Figure 10:
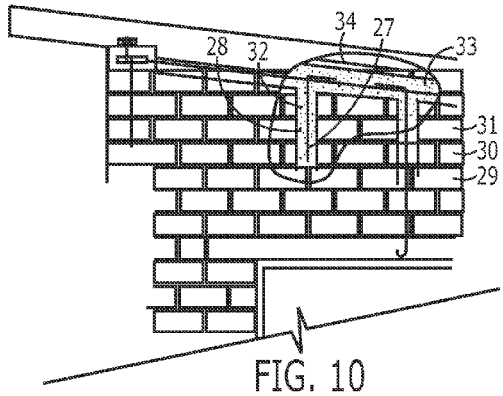
FIG. 10 is a side cross-sectional view of a wall having an anchor rod placed therein.
Figure 11:
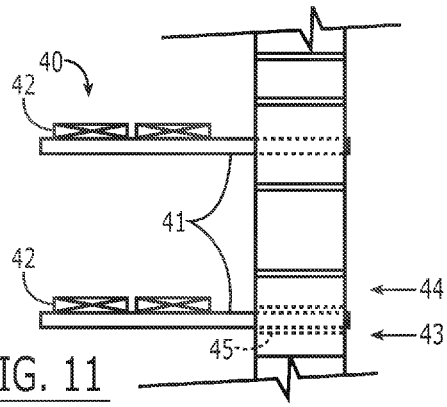
FIGS. 11 and 12 are side and top plan views, respectively, of the scaffolding system.
Figure 12:
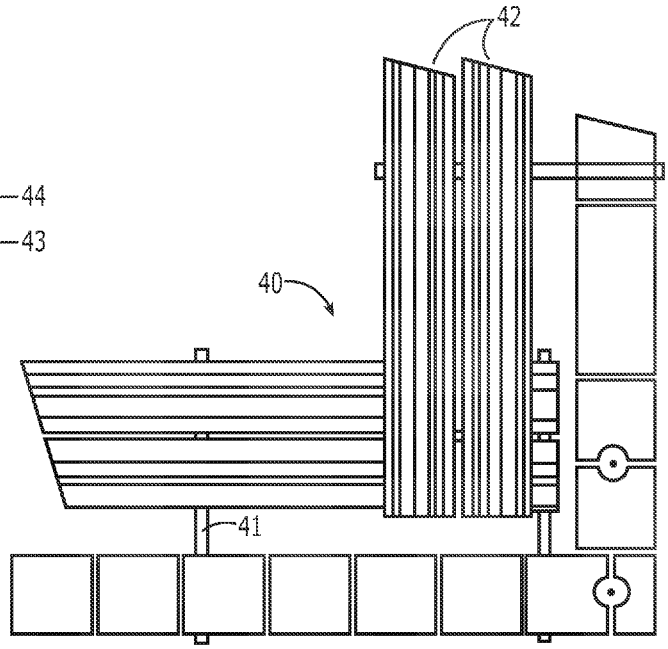

FIGS. 8-9B illustrate rebar 24 placement and brick types for each course of bricks to be laid. Note that a half-brick 15 is turned on the first course 25 so that its longest dimension is on the face of the building. The second course 26 is formed similarly, with the half-brick 15 oriented with its longest dimension ninety degrees from that in the first course 25. Also note the use of a pair of U-bricks 12 facing each other to form a hole through which rebar 24 can pass. In planned locations the wall reinforcing bars lock the footings to the top-plate (or bond-beam), which in effect "sandwiches" the wall together. Deformed rods are overlapped and are grouted with concrete, which functionally joins them along the length of the entire wall.

Further reinforcement is provided by pouring buckets of concrete grout into the core hole surrounding the rebar. While each bucket is poured, another person uses a sturdy square stick, 6 ft long×1¼ in.×1¼ in. (2 m×30 mm×30 mm) to "pump" the grout into the hole. The pumping action fills every nook in the core locking the wall together with the rebar and forming a reinforced column within the wall.

"Anchor rods" 27 (FIG. 10) are formed by creating a 4.5-in. (115-mm) vertical core 28 within the final three courses of bricks 29-31. A rod 32 is cut to approximately 32 in. (800 mm), and a 2-in. (50-mm) bend 33 is formed at the end that goes into the core 28. The rod 32 is then grouted into the core 28 when the main reinforcing is grouted. Anchor rods 27 serve to anchor the top-plate or bond-beam 34 to the top of the adobe walls, thus anchoring the roof against wind-loads, etc. The anchored top-plate or bond-beam serves to hold the top of the wall together in the event of seismic activity. Lintels and arches also must be incorporated with anchor rods.

Once the tenth course of bricks has been laid, all rebars are extended by cutting 63-in. (1600-mm) lengths and tying alongside the rebar exiting the cores (making sure that the rebars match in diameter). This will allow the proper length so they can be folded over the top-plate (or into a concrete beam).

The top-plate or bond-beam should be anchored to the adobe wall every 30 in. (750 mm). The main wall reinforcing also anchors the top-plate or bond-beam, but anchor rods must be placed between these if they are more than the required 30 in. (750 mm) apart.

If horizontal mesh is to be used, it is normally placed on the top of every fifth course (fifth, tenth, fifteenth, etc.) before the mortar is placed for the next course. The mortar will ultimately hold the mesh in place, but this mesh can be temporarily tacked in using galvanized (rust-proof) 1¼-in. (30-mm) building staples or 2-in. (50-mm) nails bent over. The staples and nails remain in place.

The scaffolding system 40 (FIGS. 11 and 12) of the present invention requires no support from the ground. The scaffolding system 40 comprises scaffolding pipes 41 inserted into scaffold bricks 18,19 at predetermined intervals, and a plank 42 placed atop the scaffolding pipes 41 upon which a worker can stand to reach higher elevations of the building.

In a particular embodiment, a 1-in. (48-mm) scaffolding pipe is placed directly in the corners and then every 4 ft (1200 mm) on centers. If there is an opening in the wall (i.e., a window, door, or other opening) that exceeds the 4-ft (1200-mm) center requirement, then standard scaffold equipment should be used to bridge the gap.

Preferably a minimum of six adobe brick courses are laid with mortar (completed/finished) over the scaffold pipe locations. This gives sufficient weight to carry the scaffolding and its load of people and bricks, all without needing additional support from below. Planks should preferably not be cantilevered beyond the support member.

The mortared-in brick weight holding these scaffold pipes in place is about 1600 pounds (730 kg) per single pipe. The pipes can protrude 40 in. (1 m) from the wall and carry two scaffold planks, plus the combined weight of bricks and workers to about 900 pounds (410 kg), with a safety factor of 8 (factoring in the modulus of rupture between the fourth and the fifth courses), and the grouted reinforced concrete columns. This allows for sturdy, adaptable scaffolding that costs a fraction of the most common scaffolding type (which must be built from the ground up).

Once the third course of bricks is complete, the location for the scaffolding pipes can be marked boldly (for example, with green paint) all the way across the top of the third course and also on the inside face of the wall (so that they are difficult to miss).

To create the scaffolding, the mortar and the bricks for the fourth course 43 are laid as normal, but when a mark is reached, a scaffold-standard brick 18 or a scaffold-U brick 19 is inserted as necessary. While laying each scaffold brick, a short level should be placed in the divot so that the scaffold bricks will be level and thus the scaffold pipes will be level.

When the fifth course 44 is ready for laying, lengths of PVC pipes are laid in each scaffold brick divot. These can be, for example, 2-in.-(50-mm-) outside-diameter PVC pipe cut into 18-in. (450-mm) lengths. The two mortar strips are laid right over the PVC pipes as normal. The fifth-course bricks are laid as normal, but periodically a brick that has already been laid over a PVC pipe should be lifted to ensure the mortar has encased the PVC pipe. The PVC pipes can be removed after about 20 minutes (but being sure that the mortar is set well enough). A 1-in. (47-mm) steel or aluminum scaffold pipe can be inserted in the hole to ensure the pipe slides freely through the wall.

After six courses of bricks have been laid over the top of the scaffold-hole location, an ordinary scaffold pipe 41 (1 in. or 42 mm in diameter) is inserted into the hole 45. For brick laying scaffolding is only needed on the inside of the building, requiring a pipe length of at least 40 in. (1000 mm). The pipe 41 must be inserted all the way into the wall, leaving ¾ in. (20 mm) protruding on the outside of the wall. The end should be inspected periodically to ensure full insertion. The remainder of the pipe protrudes from the inside of the wall by about 27.5 in. (700 mm). This will allow a 6-in. (150-mm) gap between the wall and the first 9.5 in. (240 mm) scaffolding plank and a 1¼-in. (30-mm) gap in between the two planks, leaving 1¾ in. (40 mm) pipe to spare.

Longer pipe can also be used to create scaffolding on both sides of the wall, which is particularly useful when constructing gable end walls (walls that slope to a peak for the roof) or for plastering.

The scaffold pipes can be relocated quickly and can even form multi-level, stair-step-type scaffolding for rapid access. Later, the holes are simply filled with adobe mud and cannot be seen.

For installing electrical, plumbing, and service systems, without altering the bricks, vertical pipes with the wall (for electrical conduits, service pipes and conduits, or plumbing pipes) can be as large as 4 in. (100 mm) (i.e., the size of the cores in the bricks). However, it is quite simple and fast to widen the cores or channels with a skutch (masonry hammer one end and replaceable cutting teeth at the other end). Alternatively, a rasp that is made from a reinforcing bar can be used. The vertical cores can be widened up to about 6.5 in. (165 mm) diameter, and it is easiest to widen cores before the brick is laid.

Horizontal pipes can be as large as 1.5 in. (33 mm) outside diameter. When horizontal pipes are placed over scaffold bricks, the brick is run sideways to form a horizontal channel. The horizontal channels can be widened up to about 7.5 in. (190 mm) diameter, and it is easiest to widen channels with a skutch or a small pick-ax after the bricks are laid (wait 45 minutes).

When a pipe larger than 6 in. (150 mm) is needed, it is housed in a dummy column built onto the outside or inside face of the wall. It can be built from half-bricks (without a "U" in them) as long as they are tied to the main wall with their patterning and mesh, and they have a footing depth of 300 mm (450 mm for two story) into firm ground.

Pipes can emerge through the top-plate (or the bond-beam) to be connected to services in the roof cavities or they can emerge below floor level. In most cases pipes emerge from both the floor level and the top of the wall. Pipes that are rising (called "risers") out of the slab or footings are extended to 59 in. (1470 mm) off the slab or footing level. After the second level of scaffolding is installed, the pipes should be extended by another 55 in. (1400 mm). If the pipe has any space around it in the core, adobe mortar should be used to grout in.

Electrical outlets (power points) are most often located on the third course. Electrical switches are most often located on the ninth course, although they can be anywhere that is needed. A U-brick turned sideways is used to house the box that should be free from any defect on the side that houses the box. The metal or plastic boxes are screwed to either a cut piece of plywood, as a packer, or directly to the U-brick itself, depending on the depth of the box. The box should be mounted plumb (or level) and can be mounted flush with a finished wall surface or up to ½ in. (12 mm) below it. Circuit or meter boxes can be recessed, or rebated, into an area of the wall that was built from bricks narrower than the main wall.

The building can be finished by installing windows and doors, and by applying wall finishes on the inside and outside. It will be appreciated by one of skill in the art that the system is completely flexible and amenable to a wide range of architectural designs and elements, such as arches, lintels, and joinery to suit the taste of the owner.

What is claimed is:

1. A method of constructing an adobe wall comprising the steps of:

forming a plurality of adobe bricks, at least some of the bricks having an aperture therethrough extending from a top surface through to a bottom surface;

assembling a plurality of layers of the adobe bricks atop one another to form a substantially vertical wall structure, so that the apertures align to form a substantially vertical channel;

inserting an extended reinforcing member through the vertical channel;

pouring a settable building material into the vertical channel;

permitting the building material to set around the reinforcing member;

inserting at least two scaffolding pipes substantially horizontally and parallel to each other through holes in the brick layers in spaced-apart relation from each other and above ground level;

resting a support member atop the scaffolding pipes to form a scaffold;

removing the support member and the scaffolding pipes from the wall; and filling the holes with adobe mud to ensure an integrity of the wall.

2. The method recited in claim 1, further comprising the step, prior to the pouring step, of inserting a services conduit through the vertical channel.

3. The method recited in claim 1, wherein:

the at least some of the bricks having the aperture therethrough comprise a first type of adobe brick having an aperture comprising a hollow core and a second type of adobe brick having an aperture comprising a half-cylindrical aperture in a side face thereof; and the assembling step comprises alternating a first type of row including the first brick type with a second type of row including the second brick type in a pattern wherein bricks in the first row type overlap bricks in the second row type by one-half, each second row type having pairs of the second brick type with the half-cylindrical apertures facing, so that a complete cylindrical hole is formed.

4. The method recited in claim 1, wherein the forming step comprises molding the adobe bricks using a composition consisting of the following components: sand (70-75%), silt (≦35%), clay (20-25%), gravel/aggregate (≦25%), and sufficient water to achieve a desired consistency for molding.

5. The method recited in claim 4, wherein the composition components have a grain size (diameter) of: sand, 0.006-2 mm; silt, 0.002-0.06 mm; clay, <0.002 mm; and gravel/aggregate, ≦16 mm.

6. The method recited in claim 4, wherein the composition further comprises Portland cement in a range of 3-12%.

7. The method recited in claim 1, wherein:

the forming step further comprises forming a third type of adobe brick having a half-cylindrical channel extending across a first face thereof from a front face through to a rear face, the channel positioned completely within one-half of the first face;

the first type of row can include two third brick types positioned in spaced-apart relation from each other, with the first face comprising a top face thereof; and the second type of row can include two third brick types positioned atop the two third brick types in the first type of row, the first face comprising a bottom face thereof, so that the channels of the third brick types align to form the holes in the brick layers.

8. The method recited in claim 7, wherein the assembling step comprises placing mortar between adjacent bricks and permitting the mortar to set, and further comprising the steps of:

following the mortar-placing step, inserting a cylindrical member into the formed holes in the brick layers to retain an openness of the holes; and following the mortar-set-permitting step and prior to the scaffolding pipes inserting step, removing the cylindrical member.

9. The method recited in claim 1, wherein the scaffolding pipes are inserted in brick layers that have at least six additional brick layers assembled thereabove.

10. The method recited in claim 1, further comprising the steps, following the permitting step, of:

making a vertical channel through a plurality of brick layers from a top layer of the wall;

inserting a first leg of a substantially "L"-shaped rod into the vertical channel;

placing an upper support atop the top wall layer, a second leg of the rod adjacent the upper support; and grouting the first leg into the core and the second leg and the upper support to the top wall layer.

11. The method recited in claim 1, further comprising the step, following the assembling step and prior to the pouring step, of passing a service conduit through the vertical channel.

12. A method of forming a scaffolding system in a wall under construction comprising the steps of:

assembling a plurality of layers of modular building elements atop one another to form a substantially vertical wall structure, at least two of the building elements having a horizontal channel formed therein on a horizontal face thereof, the at least two building elements at a same height above ground level and in spaced relation from each other;

inserting at least two scaffolding pipes substantially horizontally and parallel to each other through the channels;

resting a support member atop the scaffolding pipes to form a scaffold;

removing the support member and the scaffolding pipes from the wall; and filling the holes with settable building material to ensure an integrity of the wall.

* * * * *